United States Patent [19]

Gutierrez

[11] Patent Number: 5,020,581

[45] Date of Patent: Jun. 4, 1991

[54] PROCESS FOR INSERTING RIGID SEGMENTS IN SECURITY PAPER

[75] Inventor: Felipe Gutierrez, Madrid, Spain

[73] Assignee: Charlesworth Overseas Limited, Ramsey, Isle of Man

[21] Appl. No.: 587,140

[22] Filed: Sep. 24, 1990

[51] Int. Cl.[5] ..... D21H 21/42

[52] U.S. Cl. ..... 162/103; 162/105; 162/140; 156/265; 156/302; 156/303

[58] Field of Search ..... 162/138, 140, 103, 268, 162/256, 322, 105, 106; 428/900, 916; 156/244.12, 244.25, 244.26, 265, 300, 302, 303; 283/72, 82

[56] References Cited

U.S. PATENT DOCUMENTS

| | | | |
|---|---|---|---|
| 3,915,780 | 10/1975 | Broussard, Jr. | 156/244.12 |
| 4,160,694 | 7/1979 | Futcher | 162/256 |
| 4,496,428 | 1/1985 | Wells | 162/256 |
| 4,511,616 | 4/1985 | Pitts et al. | 428/900 |
| 4,761,205 | 8/1988 | Crane | 162/140 |

*Primary Examiner*—Richard V. Fisher
*Assistant Examiner*—Charles K. Friedman
*Attorney, Agent, or Firm*—J. Sanchelima

[57] ABSTRACT

A process for inserting rigid segments into a paper web being formed in a paper manufacturing process that includes the use of a paper forming screen roll, including the steps of cutting segments from a continuous rigid wire material and placing the rigid segments on a continuous strip of an adhesive carrier and placing elastic filler between the rigid segments placed on the carrier, forming a continuous elastic jacket covering the rigid segments and the filler means thereby forming a hybrid band. Through tensioning, the hybrid band is pre-stressed before feeding the pre-stressed hybrid band to the paper forming screen roll, sensing the position of the hybrid band on the paper forming screen roll, sensing the position of the hybrid band on the paper web, and regulating and controlling the positioning of the hybrid band through the adjustment of the tensioning in accordance with the position of the hybrid band in the paper web.

4 Claims, 4 Drawing Sheets

PROCESS FOR INSERTING RIGID SEGMENTS IN SECURITY PAPER

BACKGROUND OF THE INVENTION

1. Field of the Invention

The present invention relates to a process for inserting rigid segments in a continuous web of paper, and more particularly, to such a process that requires the insertion to take place during the formation of the web of paper.

2. Description of the Related Art

A number of techniques have been used to code security paper, such as the paper used for legal tender bills and negotiable instruments in general that carry a nominal value superior to their intrinsic value. Most of these techniques involve the use of water marks and other impressions on the paper that attempt to make it unique in order to frustrate the efforts of wrongdoers that try to duplicate these techniques. The use of a rigid body, preferably with ferromagnetic characteristics in one of the contemplated applications of the present invention, inside the paper creates an unsurmountable burden for these wrongdoers, specially if the rigid segment can be uniquely coded.

The insertion of a rigid body in a paper web faces a number of problems. One of these problems is associated with the marked difference in coefficients or modulus of elasticity of the paper being formed and the rigid body being inserted. This is further complicated by the demands imposed by the current production processes of large quantities of security papers such as the one used for printing money bills, stocks, bonds, checks, etc., which require the precise alignment of these rigid segments in relatively large sheets for subsequent cutting and printing operations.

SUMMARY OF THE INVENTION

It is one of the main objects of the present invention to provide a process for inserting a rigid segment into a web of paper being formed in precise locations.

It is another object of the present invention to provide a process that compensates for the different coefficients or modulus of elasticity inherently characterizing a web of paper under formation and a rigid segment being inserted.

It is still another object of this invention to provide such a process for inserting rigid segments in the paper web without causing it to rupture.

It is yet another object of this invention to provide such a process that is inexpensive to implement while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
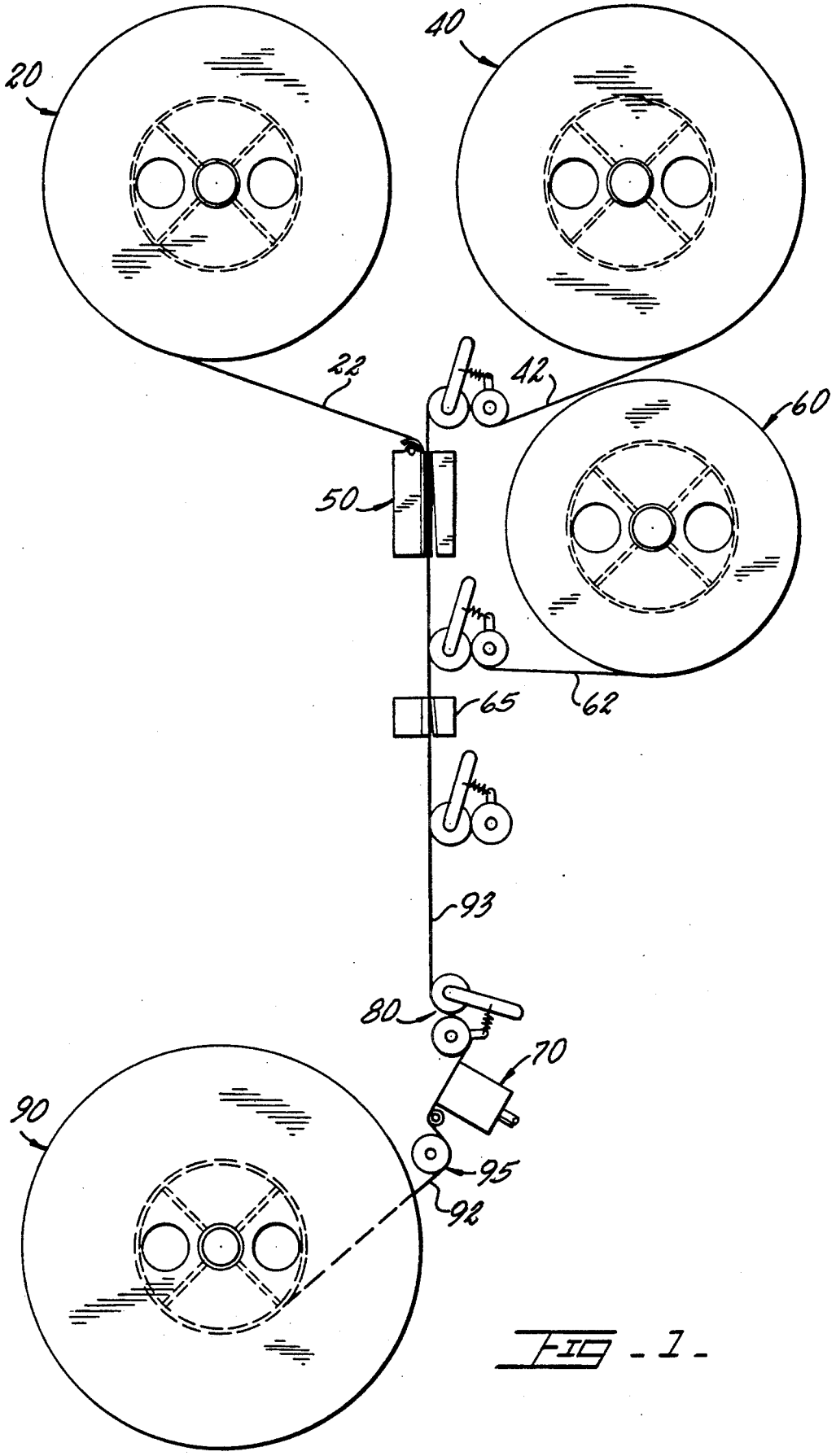
FIG. 1 represents the machinery used in the process of manufacturing the hybrid band required for its subsequent insertion in the paper web.

Referring now to FIG. 1, a continuous adhesive carrier strip is supplied by adhesive carrier supply reel 20 wherein the rigid segments will be placed. The segments are cut from a continuous rigid wire material 42 wound in a supply reel 40 that feeds it to a stepping device 50 for cutting and positioning the resulting rigid segments on the adhesive carrier. The advance sequence of the rigid wire material 42 in stepping device 50 and the motion of the core drive mechanism 80 are controlled so that the dimensions of the resultant core are precisely controlled. For the purposes of this application the core consists of the assembly comprising the adhesive tape 22 with a rigid segment correctly positioned on it and filler material described below.

A third supply reel 60 feeds an elastic filler material 62 to a filler punch 65 that cuts and deposits segments of filler material in the spaces between the rigid segments. The thickness of the filler material determines the thickness of the hybrid band in the spaces between the segments. If no filler is deposited between the segments, the spaces between the segments of the hybrid band will have the minimum possible thickness. It is possible to have a uniform thickness or to control the thickness of the filler in order to make these spaces detectable even by the human touch. This is particularly useful for blind persons ascertaining the value of the document tendered to them.

Figure 4A:
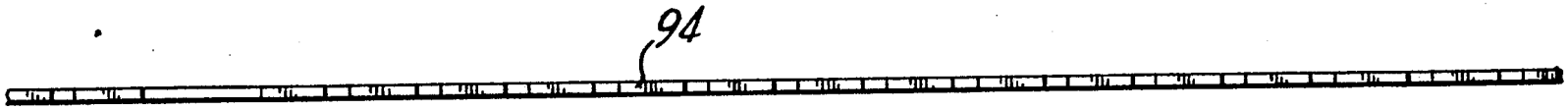
FIG. 4*a* is an enlarged top view of the hybrid band.
Figure 4B:
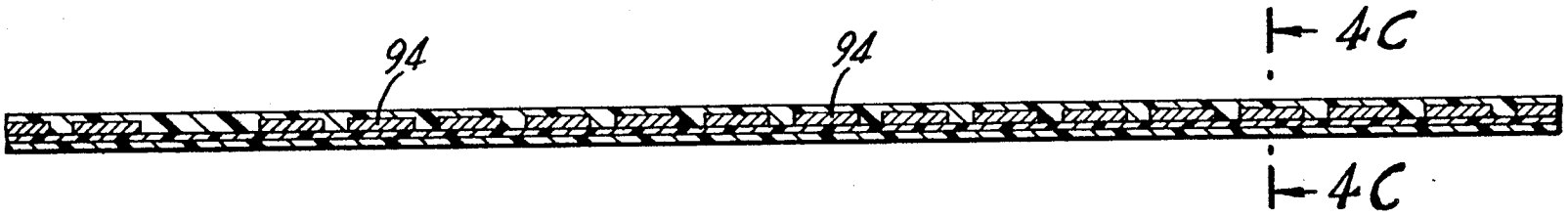
FIG. 4*b* shows side view of the hybrid band shown in FIG. 4*a* wherein the vertical dimension has been enlarged.
Figure 4C:
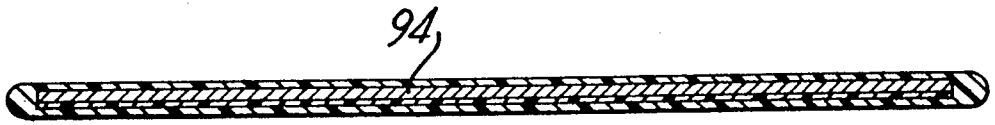
FIG. 4*c* is a cross-sectional end view of the hybrid band represented in FIGS. 4*a* and 4*b* further enlarged.

Once the core 93 has been assembled with the rigid segments and filler material placed on the adhesive carrier tape, it is fed into extrusion crosshead 70 in which an elastic jacket is formed completely surrounding the core, as best seen in FIGS. 4*a*; 4*b* and 4*c*. The resultant hybrid band 92 is collected in a suitable take-up reel 90. Extruder take up mechanism 95 pulls the extruded hybrid band 92 from crosshead extruder 70.

Figure 2:
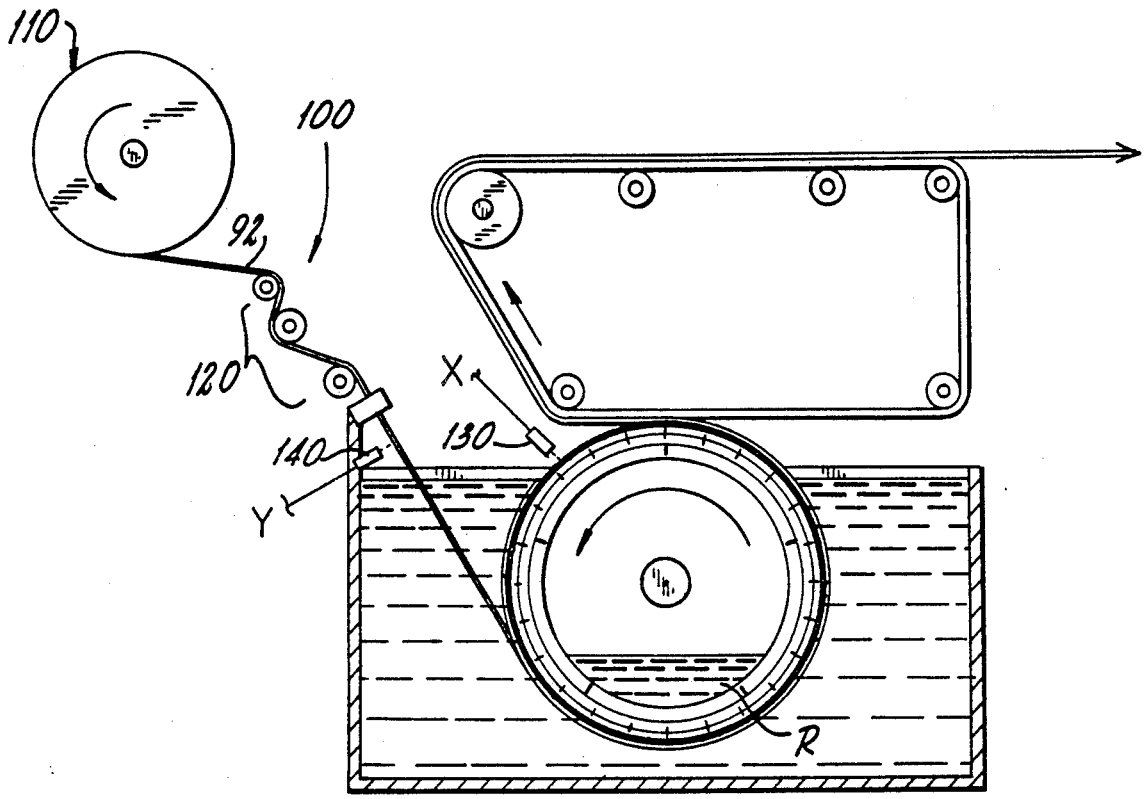
FIG. 2 illustrates the initial stage of a conventional paper manufacturing process including the mechanism that facilitates the insertion process of the hybrid band referred to in FIG. 1.

After the hybrid band has been manufactured, it is placed in insertion mechanism 100 shown in FIG. 2 where the initial stage of a conventional process for manufacturing paper is shown. Hybrid band supply reel 110 feeds hybrid band 92 into band tensioning device 120. Band tensioning device 120 pre-stretches hybrid band 92 as it is fed into paper forming screen roll R. The tension applied to the band results in a stretching of hybrid band 92. By controlling the tension applied to the hybrid band at this point, the positioning of the segments relative to the sheets of paper being formed on the screen roll can be adjusted. Sensors 130 and 140 which accurately measure the position of the screen roll R and hybrid band segments 94 are placed at appropriate locations as illustrated in FIG. 2.

Figure 3:
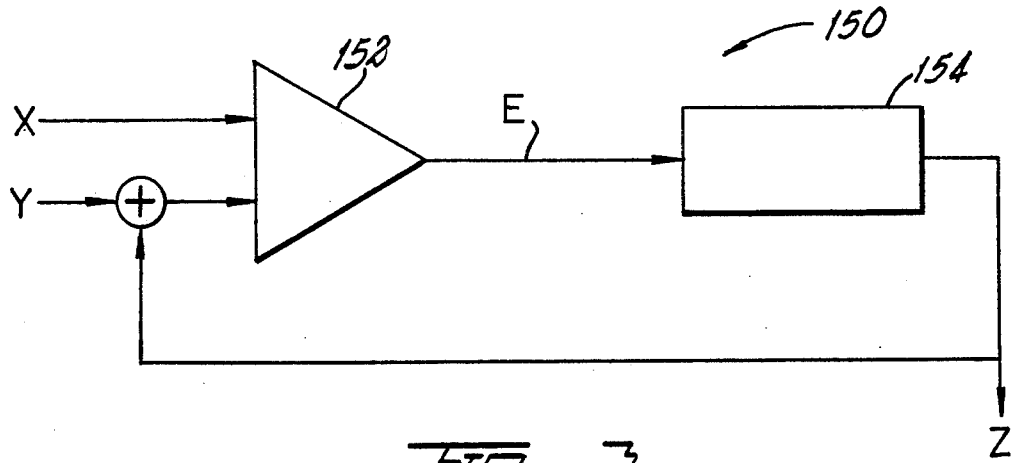
FIG. 3 is a block diagram of the servo control circuitry used to obtain the correct positioning of the hybrid band on the paper web being formed.

FIG. 3 is a block diagram of the servo control circuit 150 required to assure the correct positioning between the paper web and the hybrid band segments 94. This circuit 150 uses the signals X and Y from the position sensors of the screen-roll 130 and hybrid band segments 140 to develop an error signal E which, after suitable processing by differential amplifier circuit 152 and low pass filter and amplifier 154, is used to control the tension applied to the hybrid band by the band tensioning device 120. The resulting signal Z is sent to device 120. This maintains a correct position of the segments 94 of the hybrid band relative to the sheets of paper being continuously produced.

The error signal E produced by the control system will be positive or negative according to the direction of the misalignment detected by sensors 130 and 140. Since hybrid band 92 does not admit compressive efforts, a tensile bias is applied to hybrid band 92 such that when the error signal E is zero, a preset tension determined by the bias is applied to hybrid band 92. The corresponding bias strain is considered when dimensioning the spacing of segments 94 of the hybrid band core 93. The inventor's experience has been that a pre-tensioning strain between 1.0% and 2.0% of length has provided satisfactory results.

Figure 5:
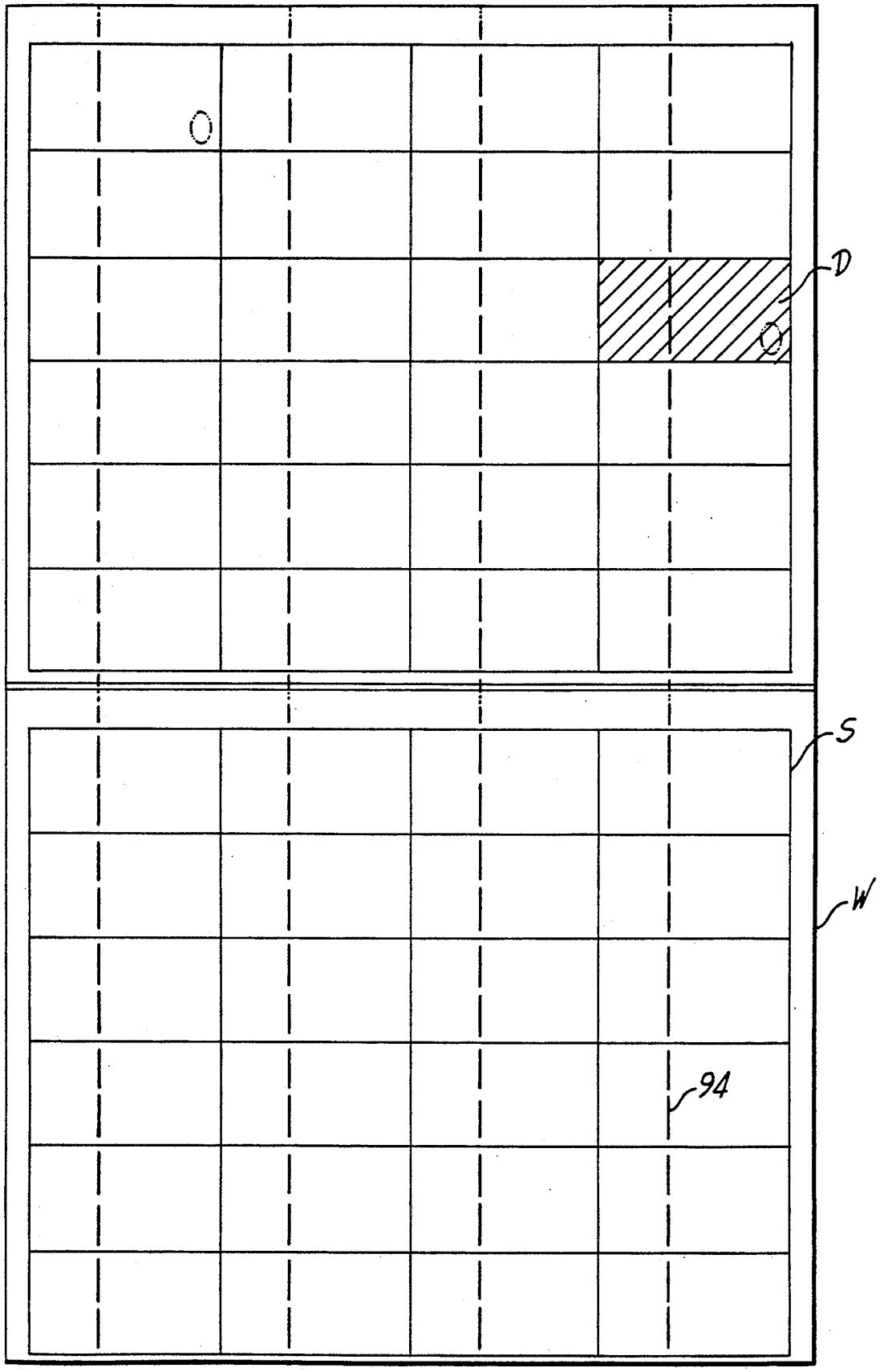
FIG. 5 is a top view of a section of the paper web that results from the process.

The resulting paper web W is shown partially in FIG. 5 where the position of segments 94 of the hybrid band are represented. Sheets S are subsequently cut containing a predetermined number of documents D for subsequent printing and cutting. In the preferred embodiment shown in FIG. 5, it can be observed that four hybrid bands 92 have been formed on web W and the process needs to be synchronized so that the relative positions of the rigid segments of each hybrid bank 92 are kept at substantially the same position relative to the paper web.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A process for inserting rigid segments into a paper web being formed comprising the steps of:

A. cutting segments from a continuous rigid wire member;

B. placing said rigid segments on a continuous strip of an adhesive carrier means;

C. placing elastic filler means between said rigid segments placed on said carrier means;

D. placing a continuous elastic jacket means covering said rigid segments and said filler means thereby forming a hybrid band; and E. feeding said hybrid band to said paper web being formed in a paper manufacturing process.

2. The process set forth in claim 1 wherein said step of forming a continuous elastic jacket means covering said rigid segments and said filler means thereby forming a hybrid band utilizes extrusion means.

3. The process set forth in claim 2 further comprising the steps of:

F. pre-stretching through tensioning means said hybrid band prior to being fed to said paper web, G. sensing the position of the rigid segments in said hybrid band prior to being fed to said paper web;

H. sensing the position of said paper web; and

I. regulating and controlling the positioning of said rigid segments in the hybrid band through the adjustment of said tensioning means in accordance with the position of said rigid segments of the hybrid band in the resulting paper web.

4. The process set forth in claim 3 further including the step of:

J. cutting said resulting web with said hybrid band formed therein so that sheets of paper result with a predetermined number of rigid segments and said cutting operation avoids said rigid segments.

* * * * *